United States Patent [19]

Ciccotelli

[11] Patent Number: 4,778,423

[45] Date of Patent: Oct. 18, 1988

[54] THERMOPLASTIC SWIM FIN

[76] Inventor: Stephen S. Ciccotelli, P.O. Box 1414, Deming, N. Mex. 88031

[21] Appl. No.: 109,833

[22] Filed: Oct. 19, 1987

[51] Int. Cl.[4] ..... A63B 31/08

[52] U.S. Cl. ..... 441/64; D21/239

[58] Field of Search ..... 441/61-64; 36/87, 97, 102; D21/236-239

[56] References Cited

U.S. PATENT DOCUMENTS 3,422,470 1/1969 Mares ..... 441/64

3,810,269 5/1974 Tabata et al. ..... 441/64

4,447,967 5/1984 Zaino ..... 36/87

*Primary Examiner*—Joseph F. Peters, Jr.

*Assistant Examiner*—Jesus D. Sotelo

*Attorney, Agent, or Firm*—William J. Ruano

[57] ABSTRACT

The blade, beams and foot pocket of the improved swim fin are all molded together in one piece of the same non-rubber thermoplastic elastomer. To provide flexibility, the part of the foot pocket that fits over the arch of the foot is formed to include a plurality of straps.

6 Claims, 1 Drawing Sheet

THERMOPLASTIC SWIM FIN

This invention relates to improvements in a swim fin.

BACKGROUND OF THE INVENTION

The foot pocket of the conventional thermoplastic swim fin is composed of thermoplastic rubber while the beams and the blade are composed of relatively hard thermoplastic elastomer. One of the major drawbacks of plastic fins is the tendency of the thermoplastic rubber material to sag on exposure to warm temperatures. Most manufacturers recommend that plastic shoe trees, packed with the fins, be inserted anytime the swim fins are not on the divers feet, but even shoe trees do not prevent warping of the foot packet.

SUMMARY OF THE INVENTION

It is the object of the present invention to overcome the above-named disadvantages by providing a thermoplastic swim fin that:

(a) requires no shoe trees to prevent sagging of the foot pocket when the foot pocket is exposed to warm temperatures;

(b) is economical to manufacture; and (c) is light in weight

The advantages of using a non-rubber thermoplastic elastomer for a foot pocket are:

(a) it is much stronger than thermoplastic rubber; therefore, the foot pocket can be made lighter in weight;

(b) the foot pocket of the improved swim fin can be injection molded in one operation with the beams and blade, whereas the conventional thermoplastic swim fin requires one molding operation to mold the thermoplastic rubber foot pocket and another to bond the beams and blade to the outside surface of the thermoplastic rubber foot pocket; and (c) unlike thermoplastic rubber, it does not sag when exposed to warm temperatures.

Heretofore, swim fin designers have considered a non-rubber thermoplastic to be too stiff for use in the upper part of the foot pocket. But by designing the foot pocket to include a plurality of straps, adequate flexibility is achieved.

Other features and advantages not specifically enumerated above will be apparent after consideration of the following detailed description and appended claims.

The presently preferred form which the invention may assume is illustrated in the accompanying drawings.

DETAILED DESCRIPTION OF THE INVENTION

Figure 1:
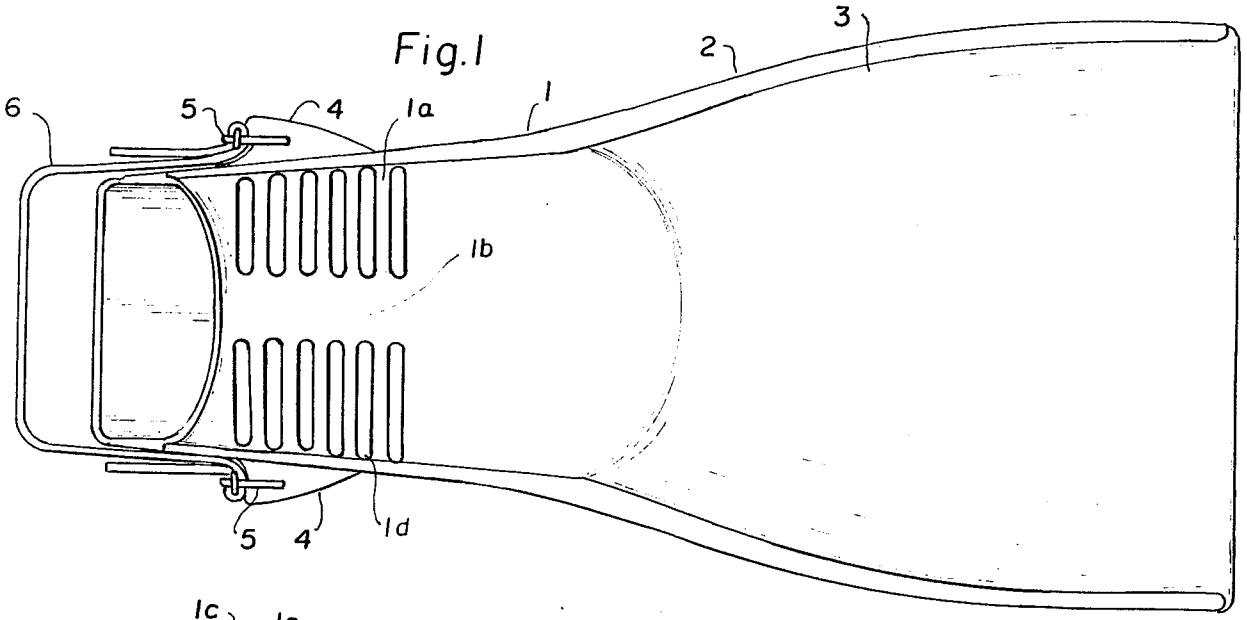
FIG. 1 is a plan view of a swim fin designed according to the present invention.

Referring to FIG. 1, the improved swim fin comprises a foot pocket 1, two beams 2 and a blade 3, the blade, beams and foot pocket all being molded in one integral piece of the same thermoplastic elastomer. On each side of the foot pocket is a boss 4 to which the buckle 5 and heel strap 6 are attached. The beams 2 extend along the sides of the foot pocket to the edge at the opening of the foot pocket.

Figure 2:
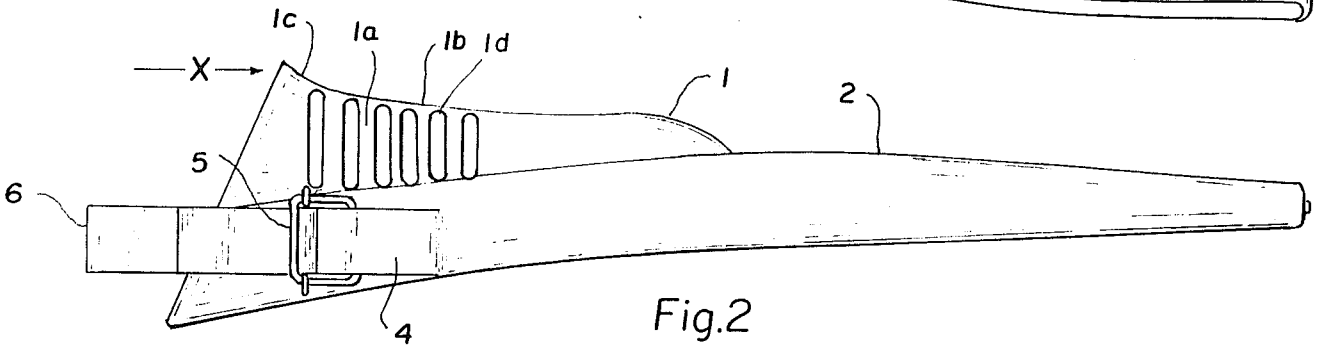
FIG. 2 is a side view of FIG. 1.

Referring to FIG. 2, the part of the foot pocket that fits over the arch of the foot comprises a plurality of straps 1*a* on each side of the foot pocket 1 with each strap having the upper end attached to a strip 1*b*, illustrated in FIG. 1 and the lower end of each strap being attached to part of a beam which extends along the sides of the foot pocket. The straps have a space 1*d* between them and the top of the foot pocket in the area near the edge 1*c* which is flared.

The foot pockets of conventional swim fins are made so that they fit either foot. The straps in the foot pocket of the improved swim fin permit the foot pocket to conform to either foot.

During swimming and walking the foot pocket must also flex in the direction of arrow X, FIG. 2. When this occurs, the strip 1*b* bends as the flared section 1*c* moves in direction of arrow X resulting in the spaces 1*d* between straps becoming smaller.

Because the plastic used in the foot pocket does not stretch, the flared section 1*c* must be molded into the foot pocket 1. Otherwise, the edge of the foot pocket will dig into the front of the ankle.

While the invention has been described with respect to a single embodiment, those skilled in the art will be able to make various modifications to the described embodiment without departing from the true spirit and scope of the invention. It is intended that all structures and techniques which are equivalent to those described herein in that they perform substantially the same function in substantially the same way to achieve the same results are within the scope of the invention.

I claim:

1. In a thermoplastic swim fin comprising: (a) a foot pocket having the part of the foot pocket that fits over the arch of the foot being formed to include a plurality of straps, the foot pocket having an open end for inserting a booted foot and a boss on each side for attaching a heel strap: (b) two beams attached to the sides of the foot pocket and projecting forwardly; (c) a blade having each lateral side attached to the part of a beam which projects from the corresponding side of the foot pocket, and the side of the blade which is nearest the foot pocket being attached to the toe area of the foot pocket, the foot pocket, beams and blade being molded in one piece and of the same grade of thermoplastic elastomer.

2. In the swim fin recited in claim 1 wherein: said straps each have an upper end attached to a strip located at the top of the foot pocket and each lower end attached to the part of a beam which extends along the side of the foot pocket.

3. In the swim fin recited in claim 2 wherein: each strap is separated from the adjacent strap by a space.

4. In a swim fin recited in claim 3 wherein: the part of the top of the foot pocket near the edge of the foot pocket is flared.

5. In a swim fin recited in claim 1 wherein: the part of the top of the foot pocket near the edge of the foot pocket is flared.

6. In a swim fin recited in claim 1 wherein: the part of the top of the foot pocket that fits over the arch of the foot and which is formed to include a plurality of straps, extends from the top of the beam on one side of the foot pocket to the top of the beam on the other side of the foot pocket.

* * * * *